United States Patent [19]

Plummer

[11] Patent Number: 4,969,620

[45] Date of Patent: Nov. 13, 1990

[54] STUD CLIMBING/SUPPORT DEVICE

[76] Inventor: Melvin D. Plummer, 114 E. 135th St., Los Angeles, Calif. 90061

[21] Appl. No.: 449,997

[22] Filed: Dec. 13, 1989

[51] Int. Cl.[5] ..... A47G 29/02

[52] U.S. Cl. ..... 248/246; 248/239

[58] Field of Search ..... 248/246, 245, 244, 235, 248/239, 217.1, 218.4; 182/187, 133, 134, 135, 136, 137, 92

[56] References Cited

U.S. PATENT DOCUMENTS

| | | | |
|---|---|---|---|
| 1,098,945 | 6/1914 | Frederick . | |
| 1,206,203 | 11/1916 | Brockway . | |
| 1,275,392 | 8/1918 | Collins . | |
| 1,409,800 | 3/1922 | Turner . | |
| 2,086,280 | 7/1937 | Matter | 248/295 |
| 3,019,852 | 2/1962 | Soderberg | 182/134 |
| 3,121,471 | 12/1964 | Soderberg | 182/134 |
| 3,166,868 | 1/1965 | Proxeller | 47/43 |
| 3,298,459 | 1/1967 | Bergsten | 182/92 |
| 3,561,563 | 2/1971 | Harsh | 182/92 |
| 3,970,277 | 7/1976 | Riblet | 248/246 |
| 4,225,013 | 9/1980 | Sample | 182/134 |
| 4,452,336 | 6/1984 | Sickler | 182/82 |
| 4,463,828 | 8/1984 | Anderson | 182/136 |
| 4,484,660 | 11/1984 | Baynum | 182/187 |
| 4,519,512 | 5/1985 | Frazier et al. | 248/245 X |
| 4,754,841 | 7/1988 | Koffski | 182/92 |
| 4,771,972 | 9/1988 | Shaw | 248/217 |
| 4,830,143 | 5/1989 | Fisher | 182/187 X |

FOREIGN PATENT DOCUMENTS

| | | | |
|---|---|---|---|
| 6617900 | 6/1968 | Netherlands | 248/245 |

*Primary Examiner*—Ramon O. Ramirez

*Attorney, Agent, or Firm*—Fulwider, Patton, Lee & Utecht

[57] ABSTRACT

A device for quickly, easily, and safely attaching to a vertical structural member to provide a step or support platform. Safety features incorporated in the structure of the device prevent accidental disengagement from the stud, and include a provision requiring the platform to be raised at least 30° above the horizontal to allow the device to be disengaged from the stud, a flexible snap finger to prevent accidental rotation and a hook type structure to prevent lateral displacement.

9 Claims, 2 Drawing Sheets

STUD CLIMBING/SUPPORT DEVICE

BACKGROUND OF THE INVENTION

1. Field of the Invention

The present invention relates to devices for climbing structural members and more particularly pertains to an improved portable device for safely and quickly attaching to upright wooden studs.

2. Description of the Prior Art

It is often necessary to attain heights along various structures that are beyond a person's normal reach. While ladders or scaffolding may be erectable near a particular structure to provide the necessary height, such devices are usually bulky and heavy, and consequently, cumbersome to transport, erect, and relocate. Space limitations or the lack of proper footing may preclude the use of a ladder or scaffolding altogether. The prior art has provided a number of compact devices that rely on an existing structure for support. These devices are usually configured to grasp a conveniently positioned structural member in some manner, and are typically frictionally held or locked in place upon application of weight onto their supporting surface.

U.S. Pat. No. 3,561,563 to Harsh and U.S. Pat. No. 4,754,841 to Koffski are representative examples of the prior art. Each describes a rather simple device whose position along a vertically disposed post is easily adjustable by simply lifting on its outward extension to disengage the gripping surfaces from the post and then simply sliding the entire device up or down. The device is subsequently held or locked in place by applying weight to the outwardly extending support member. The offset cantilevered arrangement of the support member in relation to the gripping surfaces provides the necessary leverage to firmly grip the post at that position.

Disadvantages inherent in the prior art are as follows. Devices similar to that described by Harsh, while providing an extremely simple, easily transportable and quickly attachable post step, pose a safety hazard as the step can easily be laterally displaced before a sufficient amount of weight has been applied thereto to lock it in place and consequently can cause the user to lose his or her footing. In addition, when such a device is attached about a stud having an uneven surface, a correspondingly unevenly distributed grip may allow the entire device to twist during use, again presenting the potential for injury.

While Koffski overcomes the described safety-related problems associated with Harsh, a Koffski-type of design entirely surrounds the post or stud member to which it is attached and therefore requires that the device is introduced over the end of such a member. This automatically precludes its use on structural members that have cross members attached thereto or where the end of the member is out of reach such as typically encountered at a construction site.

An improved device is called for that overcomes these described shortcomings and disadvantages inherent in the prior art.

SUMMARY OF THE INVENTION

The present invention provides a device which is readily attachable to an upright structural member, as for example a standard 2×4 inch wooden stud, to provide an elevated support platform. The device is quickly and easily attached to, as well as removed from, such a structural member yet provides a safe and stable platform for supporting the weight of a person stepping thereon.

The device generally includes an elongated support surface extending outwardly from a pair of mutually opposed gripping surfaces. The two gripping surfaces are perpendicular to the longitudinal extension of the support surface and are parallel to one another. Each gripping surface is longitudinally spaced and vertically offset from the other. A vertical wall member laterally offset from the device's longitudinal axis rigidly ties the two gripping surfaces together with the support surface. Each gripping surface terminates in a retainer hook defining a surface parallel to the wall member, the two retainer hooks generally extending towards one another.

The longitudinal offset of the two gripping surfaces is selected to correspond with the width of the structural member to which the device is to be attached while the distance between the wall member and retainer hooks is selected to correspond with the thickness of the structural member. The vertical offset of the surfaces in combination with the length of the retainer hooks is selected such that the width of the structural member to which the device is to be attached can be passed between the opposed retainer hooks when the entire device is sufficiently rotated above the horizontal, nominally to an angle of about 45°. The extreme angle of rotation, required before the device can be removed from the structural member to which it is attached, adds a margin of safety not found in prior art devices. Additionally, the wall member is provided with a flexible safety catch, more specifically, a snap finger, naturally biased to a position which interferes with the structural member once the device is affixed thereto, to effectively prevent even minor inadvertent rotation of the device.

Additional features include a clearing hole located in the wall member to allow the removal of any debris that may have collected that would impede the rotation of the device during disengagement from the structural member. A sharp rotator pin, projecting from the wall member, serves to initially engage the wooden stud so that a preselected height along the stud is maintained while the device is rotated into place. A belt clip is integrated in the body of the device to enhance its portability.

Other features and advantages of the present invention will become apparent from the following detailed drawings, which illustrate by way of example, the principle of the invention.

DETAILED DESCRIPTION OF THE INVENTION

As is illustrated in the accompanying drawing, the present invention consists of a stud climbing/support device which is readily portable and quickly and easily attached to, as well as detached from, an upright stud member. The device of the present invention is intended for use in situations where one desires to attain heights along various structures that are beyond a person's normal reach, when the use of a step ladder or scaffolding is either precluded or inconvenient. Such a situation is often encountered by, for example, tradesmen performing numerous tasks throughout the workday at perhaps a variety of different job sites which may require a few steps above ground level and the transportation of and repeated set up and take down of a ladder poses a nuisance. The device of the present invention can be carried at one's side, is quickly attachable to an upright stud, provides a stable support surface and is quickly detachable.

Figure 1:
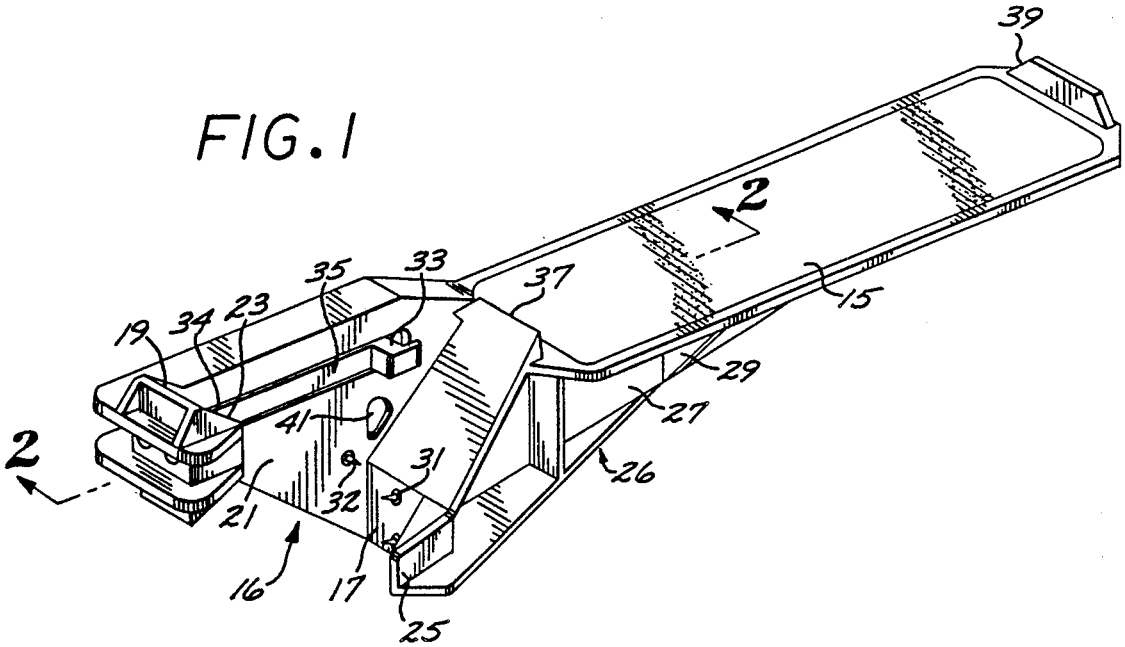
FIG. 1 is a perspective view of the device of the present invention.
Figure 2:
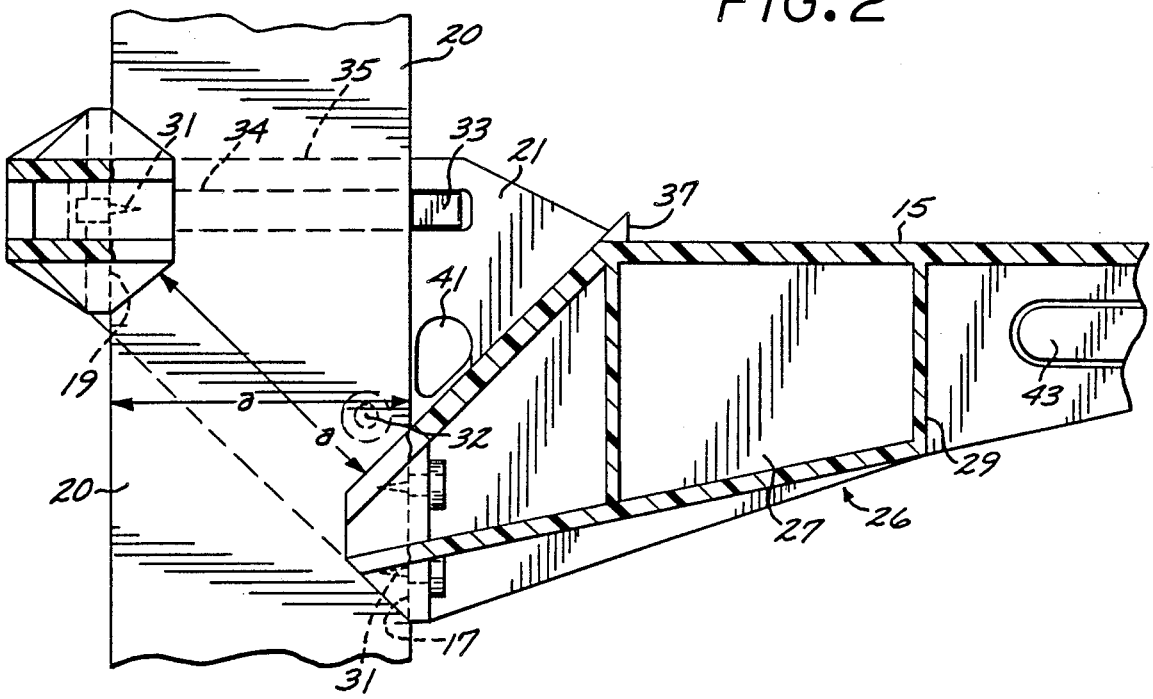
FIG. 2 is an enlarged cross-sectional view of the device taken along line 2—2 of FIG. 1 while engaged to a structural member.
Figure 3:
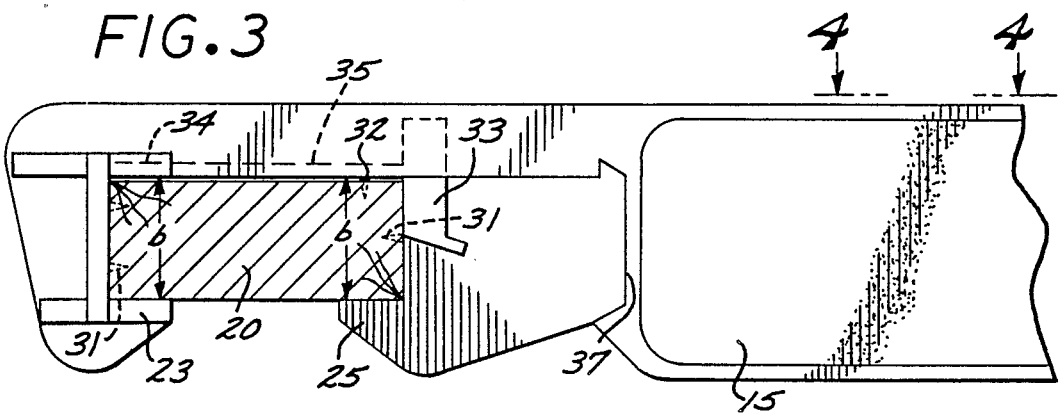
FIG. 3 is an enlarged top plan view of the device illustrated in FIG. 2.
Figure 4:
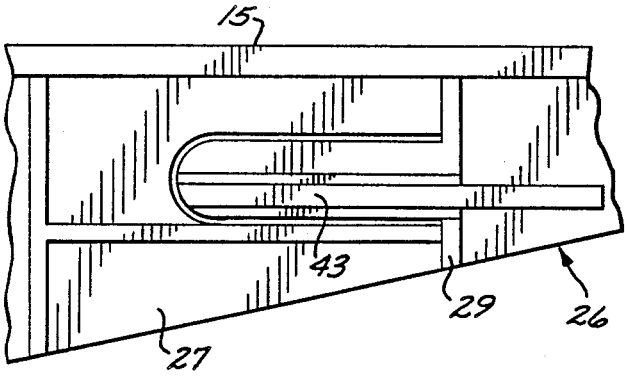
FIG. 4 is an enlarged side plan view taken along lines 4—4 of FIG. 3.

As shown in FIG. 1, the device consists generally of a support platform 15 and a stud engaging section 16. The support platform 15 provides a horizontal surface large enough to easily accommodate a person's foot, or alternatively, a horizontal scaffolding member. The support platform's 15 supporting surface is punctuated at its proximal and distal ends by a raised curb 37, 39 and is additionally provided with an anti-skid surface. A reinforcing substructure, generally designated 26, featuring a plurality of webs 27 and ribs 29, increases the load carrying capacity of the support platform 15 and ties it into the stud engaging section 16.

The stud engaging section 16 consists of a pair of mutually opposed gripping surfaces 17, 19 and a wall member 21 extending therebetween. Each gripping surface 17, 19 terminates in a retaining hook 23, 25 opposite the wall member 21. Each gripping surface 17, 19 is further provided with a friction enhancing finish or with, for example, the inclusion of a number of spiked studs 31. The longitudinal spacing "a" between the gripping surfaces 17 and 19 corresponds to the width of the structural member 20 to which the device is intended to be attached, while the distance between the wall member 21 and the retaining hooks 23, 25 "b" corresponds to the thickness of said member 20. Additionally, the distance between the retaining hooks 23, 25 also corresponds to "a", the width of the structural member 20, said dimension being measurable at an angle of no less than 30° and preferably 45° relative to the horizontal.

An additional feature incorporated in the wall member 21 is a flexible retaining means in the form of a snap finger 35. The snap finger 35 is flexibly attached to the wall member 21 at 34 and terminates in a raised tab 33 that projects out of the plane of the wall member 21 and into the interior of the gripping section 16. The distal edge of the tab member 33 is vertically aligned with gripping surface 17. A rotator pin 32, in the form of an elongated spike, projects from the wall member 21 towards the interior of the gripping section 16. A cleaning hole 41 extending through the wall member is located just below the tab 33 and just above the gripping surface 17. A clip 43 extends from one of the ribs 26 and is sized to engage a user's belt.

The preferred method of construction of the device of the present invention is by injection molding. The material of choice is XENOY 6370, a G.E. Plastics glass-reinforced alloy of polycarbonate/polybutylene terephthalate. This material enables the design, substantially as illustrated and described, to easily support a 300 pound load, and additionally, imparts a service life of on the order of one million cycles to the flexible snap finger 35.

Figure 5:
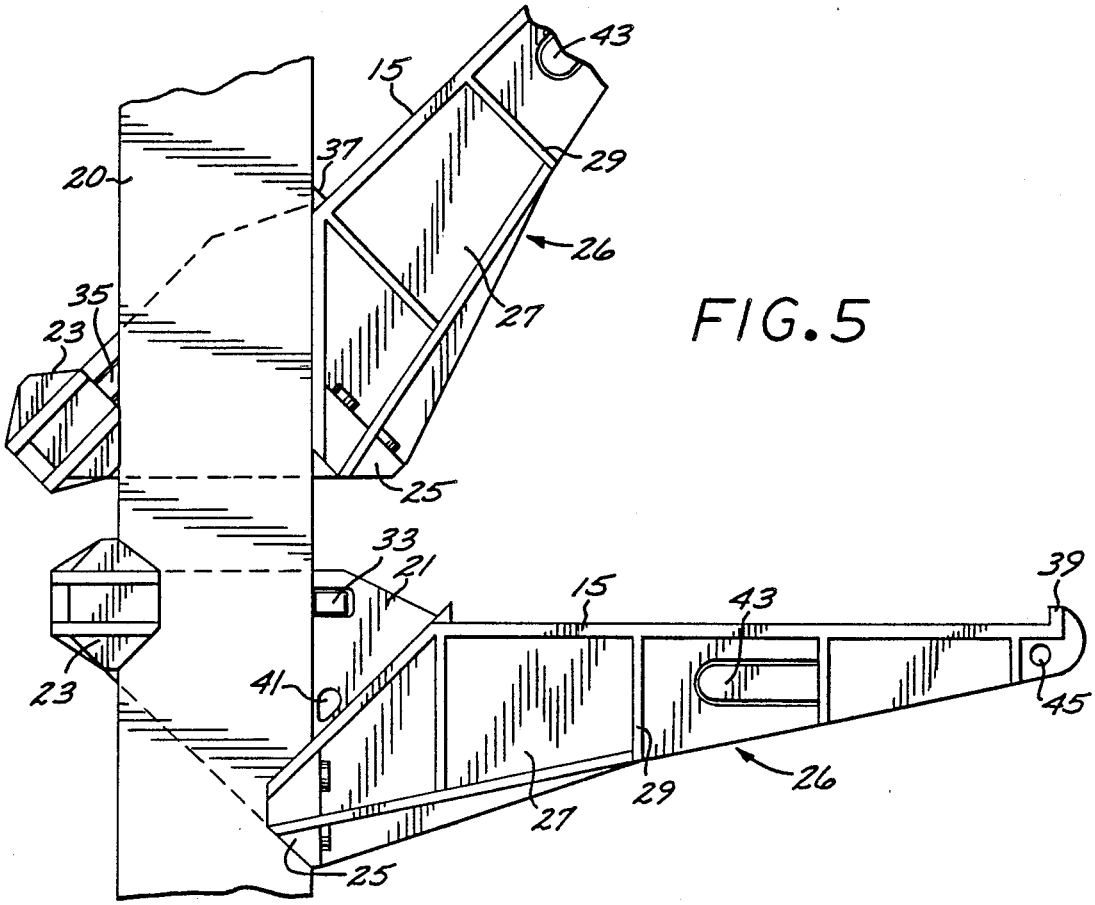
FIG. 5 is a multiple side plan view of the device of the present invention illustrating its attachment about a vertical structural member.

In use, the device is first rotated above the horizontal to allow the structural member to pass between the retainer hooks 23, 25, as illustrated in FIG. 5. As previously mentioned, dimensions "a" and "b" are selected such that the device can be used on a preselected structural member, which in the case of a 2×4 wooden stud is approximately 1½"×3½". In the appropriate angled position, the width of the 2×4 can be passed between the offset retaining hooks 23 and 25, and engage the rotator pin 32, which readily penetrates the wooden surface. This provides a pivoting hinge point with which the height of the entire device along the stud 20 is maintained while it is rotated into its horizontal position also illustrated in FIG. 5. As the device attains its horizontal position, studs 31 penetrate the edges of the wooden stud 20 and are then completely driven home when weight is applied to the support platform 15. The position and flexibility of snap finger 35 causes the tab 33 to be depressed into the plane of the wall member 21 when the stud 20 is first engaged. After rotation into its horizontal position, the snap finger 35 snaps back such that the tab 33 projects beyond the wall member 21 surface. Once in this position, the studs 31 ensure that the entire device is positively located along vertical of the stud. The retainer hooks 23 and 25 prevent the device from being laterally displaced from the 2×4 while the tab 33 of snap finger 35 prevents the device from being rotated back up to an elevated angle. In this position, the device is quite capable of supporting the weight of a human. Alternatively, two or more such devices can be employed to carry a horizontal scaffolding member laid across the support surfaces 15.

In order to disengage the device from the stud, it is necessary to depress tab 33 to a position flush with the wall member 21, which then allows the distal end of the device to be lifted upwardly to an angle of 45°. Once at 45°, the space between retaining hooks 23, 25 is aligned with the width of the stud 20 and thereby allows the device to be extracted from the stud. Any debris that may have become lodged between stud 20 and device preventing its upward rotation may be cleared away through hole 41. Clip 43 enables the entire device to be carried at one side attached to one's belt. Hole 45 allows the device to be hung from a nail for storage.

While a particular form of the invention has been illustrated and described, it will also be apparent to those skilled in the art that various modifications can be made without departing from the spirit and scope of the invention. Accordingly, it is not intended that the invention be limited except as by the appended claims.

What is claimed is:

1. A removable support device attachable to a vertical structural member of predefined width and thickness, comprising:

an elongated support member arranged along a horizontally oriented longitudinal axis, said support member having a support surface thereon;

a proximal gripping member- rigidly affixed to said support member having formed thereon a flat friction surface arranged perpendicularly to said longitudinal axis facing away from said support surface, and centered about a vertical plane which includes said longitudinal axis, the width of said gripping surface being defined by two retainer members, each having a vertical surface, perpendicular to said gripping surface and extending distally relative to said support surface, the distance between said retaining members being substantially equal to the thickness of the structural member;

a distal gripping member, rigidly affixed to said support member, having formed thereon a flat friction surface arranged perpendicularly to said longitudinal axis facing toward said support surface and centered about a vertical plane which includes said longitudinal axis, the width of said gripping surface being defined by two retainer members each having a vertical surface, perpendicular to said gripping surface and extending proximally relative to said support surface, the distance between said retaining members being substantially equal to the thickness of the structural member, said distal gripping surfacing being longitudinally spaced from said proximal gripping surface a distance substantially corresponding to the width of the structural member, and said distal gripping surface and said proximal gripping surface being vertically offset from one another a preselected distance such that the shortest distance between the proximally extending distal retainer member and the distally extending proximal retainer member is substantially equal to the width of the structural member, the extension of the retainer members and the amount of vertical offset between the gripping surface being selected such that said shortest distance between the retainer members defines a line oriented at least 30° from the horizontal.

2. The device of claim 1 wherein the flat friction surfaces of said proximal and distal gripping members are set with spikes.

3. The device of claim 1 wherein said distal gripping member is rigidly affixed to said support member by a vertical wall member arranged in parallel to the longitudinal axis and incorporating one of said retainer members of both the proximal and distal gripping members.

4. The device of claim 2 wherein said device is entirely formed of injection molded thermoplastic material.

5. The device of claim 3 further comprising a rotator pin extending from said wall member, positioned so as to engage said structural member and thereby provide a pivot point while the device is rotated between a raised and a horizontal position.

6. The device of claim 5 further comprising a safety catch means for preventing accidental rotation of said device while in a horizontal position about said structural member.

7. The device of claim 6 wherein said safety catch means comprised a depressible raised tab biased to project out of the plane of the wall member and positioned to interfere with vertical structural member when the support device is in a horizontal position and prevent its rotation while allowing free rotation upon depression of the tab.

8. The device of claim 7 wherein the entire device is formed of injection molded polycarbonate/polybutylene terephthalate alloy.

9. The device of claim 8 wherein said tab is formed as the terminal end of an elongated portion of wall member whereby the inherent flexibility of the wall member provides the required depressibility and the natural bias.

* * * * *